United States Patent [19]

Nakajima

[11] Patent Number: 4,971,469

[45] Date of Patent: Nov. 20, 1990

[54] AUTOMATIC PAPER LOADING MECHANISM AND METHOD FOR PRINTER

[75] Inventor: Tetsuya Nakajima, Shimizu, Japan

[73] Assignee: Star Micronics Co., Ltd., Shizuoka, Japan

[21] Appl. No.: 472,585

[22] Filed: Jan. 30, 1990

[30] Foreign Application Priority Data

Feb. 7, 1989 [JP] Japan ..... 1-28226

[51] Int. Cl.[5] ..... B41J 13/36; B41J 13/20

[52] U.S. Cl. ..... 400/636.1; 400/637.1; 400/639.1; 400/639.2

[58] Field of Search ..... 400/639.2, 635, 636, 400/636.1, 631.2, 637, 637.1, 638, 639.1, 641, 705.3, 703

[56] References Cited

U.S. PATENT DOCUMENTS

| | | | |
|---|---|---|---|
| 1,534,057 | 4/1925 | Degener | 400/639.2 |
| 2,555,645 | 6/1951 | Helmond | 400/639.2 |
| 3,519,117 | 7/1970 | Smith | 400/637 |
| 4,031,995 | 6/1977 | Blum et al. | 400/636.1 |
| 4,544,294 | 10/1985 | Runzi | 400/36.2 |
| 4,602,883 | 7/1986 | Ozawa et al. | 400/639.1 |
| 4,684,277 | 8/1987 | Edstrom et al. | 400/639.1 |
| 4,693,621 | 9/1987 | Kawaguchi | 400/636.1 |
| 4,702,632 | 10/1987 | Tauetani | 400/639.1 |
| 4,859,099 | 8/1989 | Kanemoto et al. | 400/636.1 |

*Primary Examiner*—Eugene H. Eickholt
*Attorney, Agent, or Firm*—Koda & Androlia

[57] ABSTRACT

In a printer in which a paper is pressed against a platen by a bail roller, the bail roller is automatically released from the platen, during paper loading, so as not to obstruct the paper feeding.

The bail roller is pivotally moved between a loading position and a release position by a pivoting unit. The pivotal movement of the bail roller is performed by a paper feed motor so that the drive force of the paper feed motor is transmitted to the pivoting unit via a clutch unit. The connecting and disconnection of the clutch unit is controlled as a printing head carriage is moved to an outer area outside the printing area.

15 Claims, 6 Drawing Sheets

| FIG. 6A |
| --- |
| FIG. 6B |

AUTOMATIC PAPER LOADING MECHANISM AND METHOD FOR PRINTER

BACKGROUND OF THE INVENTION

1. Field of the Invention

This invention relates an automatic paper loading mechanism and method for printers, and more particularly to an improved automatic paper loading mechanism and method in which a bail roller can be automatically retracted to a release position so as not to be an obstruction during the paper feeding and can be automatically pivotally moved to a loading position after completion of the paper feeding.

2. Description of the Prior Art

A printer is widely known in which a desired printing operation is performed on a sheet paper or a tractor paper wound on a platen as a printing head is moved forwardly and backwardly along the platen, the printing head being such as of the dot, thermal or ink jet type.

According to this known printer, automatically loading the sheet paper or tractor paper was particularly useful to improve the operativity of the printer; heretofore, various automatic paper loading mechanisms have been put to practical use.

In such known automatic paper loading, the paper is manually inserted into a paper feed unit and is then automatically advanced by the paper feed unit until its top end arrives at a predetermined position on a platen. During that time, the paper is pressed against the platen in a correct posture by means of a bail roller, which would be inconveniently a significant obstruction.

Generally, before the automatic paper loading, this bail roller is pivotally moved by hand to a release position in which it is spaced from the platen. At that time the bail roller is manually moved by a bail-roller lever so that the position of the bail roller is restricted to facilitate the manipulation of the bail-roller lever. Usually, since the bail roller is located above the platen in confronting relation thereto, a blank area of the paper between the printing head and the bail roller must be set large.

Further, pivotally moving the bail roller by hand necessarily causes the bail-roller lever to project from a printer casing, thus resulting in an increased size of the printer and also in leakage of printing noise from an opening in the printer casing through which opening the bail-roller lever extends.

To this end, following mechanisms have hitherto been proposed to automatically pivotally move the bail roller during the automatic paper feeding.

Each of Japanese Patent Laid-Open Publications Nos. 73978/1987 and 162577/1987 discloses a printer in which a bail roller is operatively connected to an exclusive motor so that the bail roller is automatically released from a platen and returned thereto during the paper loading.

Japanese Patent Laid-Open Publications Nos. 21278/1985 and 62579/1987 and Japanese Utility Model Laid-Open Publications Nos. 130446/1986, 85448/1986 and 152444/1986 individually disclose a structure in which a bail roller is pivotally moved between a loading position and a loading position by utilizing the driving force of a carriage carrying a printing head.

Further, Japanese Patent Laid-Open Publication No. 49465/1988 discloses a mechanism in which the drive force for paper feeding is transmitted to the bail roller by means of a pivoting gear so that the bail roller is pivotally moved between a loading position and a release position as the pivotal movement of the bail roller is controlled by the printing-head carrier (carriage).

However, with the foregoing prior art arrangement, since the exclusive motor or solenoid is used only for pivotal movement of the bail roller, it would necessarily increase the entire size and weight of the printer, thus making the printer expensive.

In the prior art structure in which the bail roller is pivotally moved by utilizing the driving force of the carriage, because paper loading must be conducted with the bail roller lever held outside the printing area so that the carriage retains the bail roller in the release position, it would be impossible to conduct the centering of the carriage during paper feeding.

Consequently, since a paper being fed to the bail roller cannot be pressed by the carriage, the paper can be easily jammed at the bail roller.

Further, because the pivotal movement of the bail roller is determined depending on the amount of movement of the carriage, it is relatively difficult to define the correct release position.

For another problem, in the prior art arrangement equipped with a conventional clutch unit utilizing a pivoting gear, partly because only the forward rotating force of the paper feed driving force is utilized to release the bail roller, and partly because this release driving can be controlled by a cam in a predetermined release pattern, fine control of the pivotal movement of the bail roller.

When the bail roller is driven only by the forward rotating force of the paper feed driving force, especially when high-concentration printing is conducted as the paper is slightly backwardly moved, and when printing is conducted in a laterally split manner, the paper is the bail roller cannot be retained in the release position so that fine printing control such as top margin printing cannot be achieved.

SUMMARY OF THE INVENTION

It is therefore an object of this invention to provide an improved automatic paper loading mechanism and method in which a bail roller can be pivotally moved optionally between a loading position and a release position without any exclusive drive unit and can be retained in the individual position.

According to a first aspect of this invention, there is provided an automatic paper loading mechanism for a printer, comprising: a platen for supporting therearound a paper at a predetermined printing area; a bail roller for pressing the paper against the platen; a paper feed unit having a paper feed motor for rotating the platen to feed the paper by a predetermined amount; a printing head disposed in confronting relation to the platen for performing a predetermined printing action on the paper; a carriage for moving the printing head in a direction parallel to the axis of the platen; a pivoting unit pivotally movable between a loading position in which the pivoting unit brings the bail roller against the platen and a release position in which the pivoting unit brings the bail roller away from the platen; a clutch unit disposed between the pivoting unit and the paper feed unit for operatively connecting the paper feed unit to the pivoting unit to transmit a driving force of the paper feed unit to the pivoting unit and for disconnecting the paper feed unit from the pivoting unit, the clutch unit being adapted to be switched over to its connecting position when the carriage is moved outside the printing area of the platen; and a toggle unit for resiliently retaining the bail roller at the loading position and the release position individually, the carriage being freely movable along the platen while the bail roller is being retained in the release position.

According to a second aspect of this invention, there is provided in a printer in which printing is to be made on a desired printing area of a paper wound on a platen as the paper is retained by a bail roller and as a printing head carried by a carriage is moved forwardly and backwardly and in which a drive force to feed the paper can be utilized to cause the bail roller to pivotally move between a loading position and a release position as the printing head or the carriage is moved outside the printing area to cause a clutch to assume its connecting position and in which the bail roller is retained in the loading position and the release position individually by a toggle unit, an automatic paper loading method comprising the steps of:

(a) moving the carriage to a clutch connecting position in which the bail roller is pivotally movable to a release position in which the bail roller is spaced from the platen;

(b) feeding the paper backwardly and, at the same time, pivotally moving the bail roller to the release position by the paper feed drive force and retaining the bail roller in the release position by the toggle unit;

(c) removing the carriage from the clutch connecting position to release the pivotal movement of the bail roller which movement is caused by the paper feed drive force;

(d) feeding the paper forwardly to a predetermined position;

(e) moving the carriage to the clutch connecting position; and (f) further feeding the paper forwardly and, at the same time, moving the bail roller to the loading position and retaining the bail roller in the loading position by the toggle unit.

In the paper loading mechanism of this invention, the paper feed unit is connected to and disconnected from the bail roller pivoting unit by the clutch unit to control the bail roller pivoting unit by the driving force of the paper feed unit, and the connecting and disconnecting operation of the clutch unit is controlled as the carriage is moved out of the printing area of the platen. Therefore, with this arrangement, it is possible to control the position of the bail roller by effectively utilizing the carriage and the paper feed driving force, without any exclusive motor.

Further, the loading position and the release position of the bail roller is individually retained by the toggle unit. As a result, when the bail roller is in the release position, the carriage can be centered or moved at option for printing, and both the forward feeding and backward feeding of the paper can be controlled.

In the paper loading method of this invention, the paper feed driving force is selectively transmitted to and released from the bail roller as the carriage is moved out of the printing area of the platen, and the pivotal movement of the bail roller between the release position and the loading position can be controlled depending on whether the paper feed motor is rotated forwardly or backwardly.

The above and other advantages, features and additional objects of this invention will be manifest to those versed in the art upon making reference to the following detailed description and the accompanying drawings in which a preferred embodiment incorporating the principles of this invention is shown by way of illustrative example.

DETAILED DESCRIPTION

Figure 1:
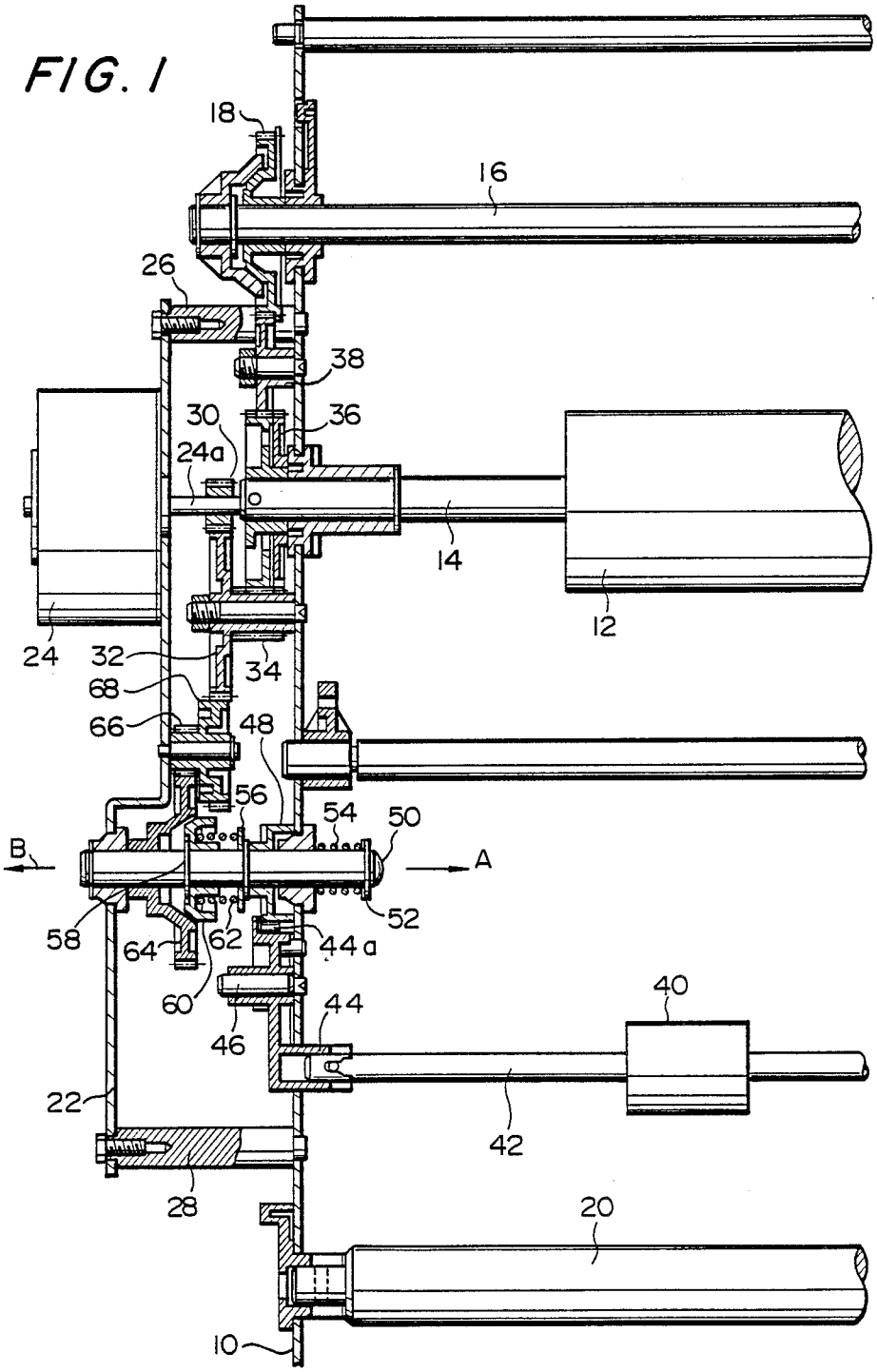
FIG. 1 is a fragmentary plan view, partially in cross section, of an automatic paper loading mechanism embodying this invention.
Figure 2:
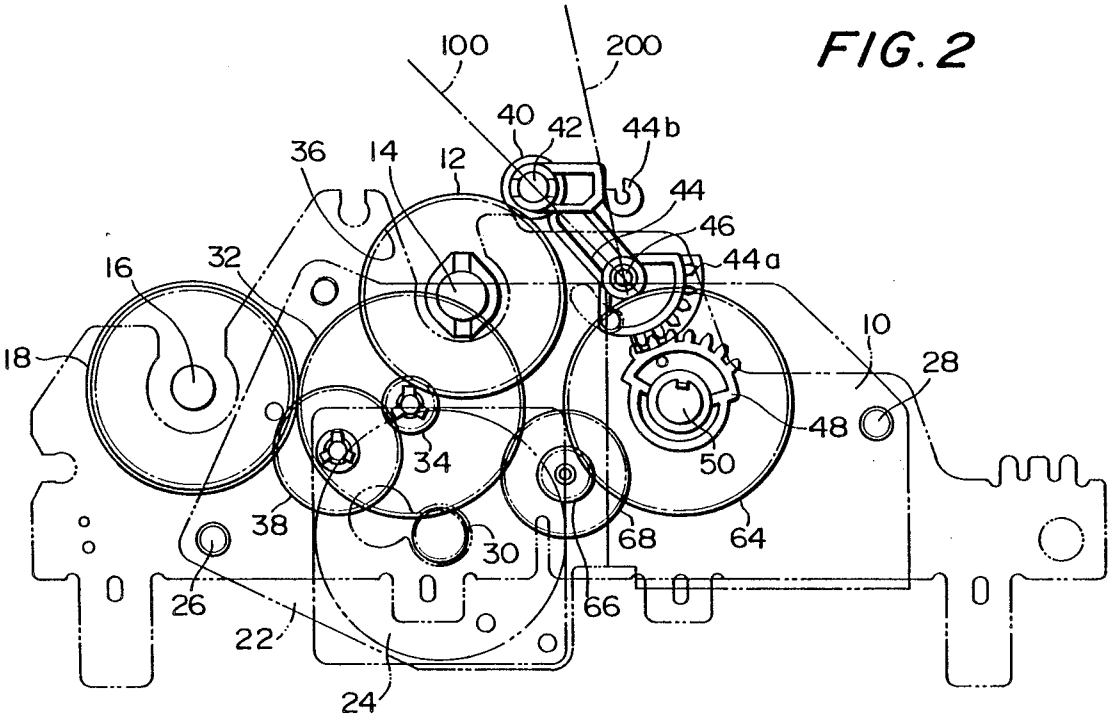
FIG. 2 is a side elevational view of FIG. 1.

The principles of this invention will be particularly useful when embodied in an automatic paper loading mechanism, for a printer, such as shown in FIGS. 1 and 2.

As shown in FIGS. 1 and 2, a shaft 14 of a platen 12 is supported by a printer casing plate 10; a sheet paper or a tractor paper is to be wound on the platen 12 for being fed to a desired position. In the case of sheet paper, the platen 12 is provided with a pinch roller intimately contacting the platen 12. The pinch roller corotates with the platen 12 to advance the sheet paper.

In the case of tractor paper, the pinch roller is released from the platen 12, and then the tractor paper is advanced by a tractor gear 18 fixed to a tractor shaft 16 supported by the printer casing plate 10.

Although there is no detail illustration in FIGS. I and 2, a printing head is located near the platen 12 for movement in the direction parallel to the axis of the platen 12. The printing head performs a desired printing on the paper wound on the platen 12, in a known manner such as dot impact, thermal transfer or ink jet.

The printing head is carried by a carriage for controlled movement in the direction parallel to the axis of the platen 12.

In FIG. 1, the carriage is slidably supported on a carriage shaft 20. In a manner described below, the carriage is movable on and along the carriage shaft 20 in the printing area as well as outside the printing area as driven by a drive means such as a pulse motor.

A paper feed unit is operable to rotate the platen 12 and the tractor shaft 16 for feeding the paper. The drive source for this paper feed unit is a paper feed motor 24 supported on a motor base 22 fixed to the printer casing plate 10 by a pair of posts 26, 28.

A main shaft **24*a* of the paper feed motor 24 is fixed to a pinion 30 meshing a transmission gear 32. A transmission pinion 34 of the transmission gear 32 meshes a platen gear 36 fixed to the platen shaft 14. So the rotating drive force of the paper feed motor 24 is the platen 12** as reduced.

The tractor gear 18 is in meshing engagement with the transmission pinion 34 via an idler 38 so that the tractor paper can be correctly fed in response to rotation of the tractor gear 18.

To hold the paper against the platen 12 intimately in a correct posture, the paper loading mechanism includes a bail roller 40 of the known construction. The bail roller 40 is composed of a plurality of roller members mounted on the bail roller shaft 42 at axial spaces. According to need, the spaces between the roller members may be adjusted axially of the bail roller shaft 42 to meet with the width of the paper.

For pivotally moving the bail roller 40 between a loading position in which the bail roller 40 is in intimate contact with the platen 12 and a release position in which the bail roller 40 is spaced from the platen 12, the bail roller shaft 42 is supported on one end of a bail lever 44 that is pivotally mounted on the printer casing plate 10 by a pivot 46. A bail lever gear **44*a* is formed on the other end of the bail lever 44, meshing with a pivoting gear 48. Consequently, as the pivoting gear 48 is driven to rotate, the bail roller 40 is pivotally moved about the pivot 46 selectively to the loading position and the release position. At that time the rotating drive force of the pivoting gear 48 is transmitted to the bail roller 40 via the bail lever gear 46**.

Figure 4:
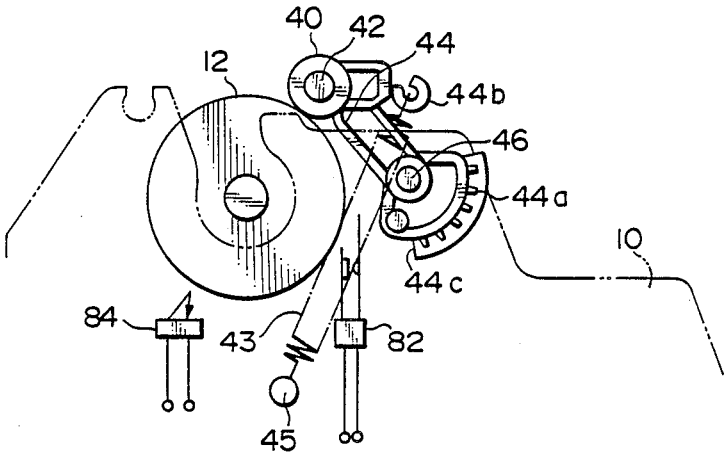
FIG. 4 is a view showing a toggle unit assuming a loading position.

For a significant feature of this invention, the bail roller 40 is retained selectively in the loading position and the release position by a toggle means. For this purpose, as shown in FIG. 4, the bail lever 44 has a hook **44*b* to which a toggle spring 43 is connected at one end. The toggle spring 43 is connected at the other end to a pin 45 fixed to the printer casing plate 10. Thus the bail lever 44 and the toggle spring 43** jointly constitute a toggle unit.

In the loading position of FIG. 4, the extension force of the toggle spring 43 imparts to the bail lever 44 a rotating force counterclockwise about the pivot 46. As a result, the bail roller 40 is stably retained in the loading position in which it is pressed against the platen 12, thus creating a suitable pressure on the paper.

As described below, when the bail lever 44 is pivotally moved to the release position of FIG. 5, the toggle spring 43 imparts to the bail lever 44 then a rotating force clockwise about the pivot 46. As a result, the release position is stably retained by the toggle means.

For another significant feature, the means for pivotally moving the bail roller 40 is releasably connected with the paper feed unit via a clutch unit. In the illustrated embodiment, the pivoting gear 48 is mounted on a clutch shaft 50 of the clutch unit axially slidably along the clutch shaft 50 and rotatably as a unit therewith.

Figure 3:
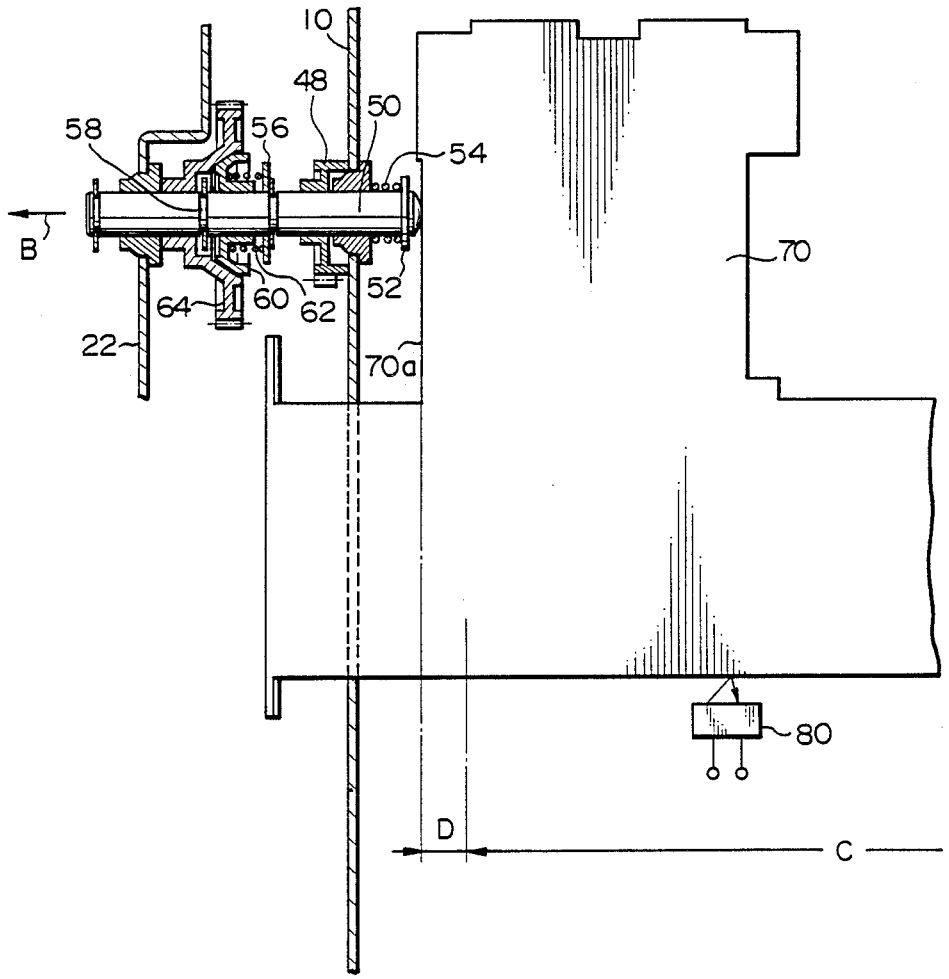
FIG. 3 is a view showing the manner in which a clutch unit assume a connecting position.

The clutch shaft 50 is slidably and rotatably supported by the printer casing plate 10 and the motor base 22 and is normally urged in the direction of an arrow A by a clutch return spring 54 disposed between the printer casing plate 10 and a stop ring 52, as shown in FIG. 3.

Two stop rings 56, 58 are fixedly attached to the clutch shaft 50. An inner clutch plate 6 is mounted on the clutch shaft 50 axially slidably along the clutch shaft 50 and rotatably as a unit therewith, at which time the axial movement of the inner clutch plate 60 is restricted by the one stop ring 58. A clutch spring 62 is disposed between the clutch plate 60 and the other stop ring 56 to normally urge the inner clutch plate 60 in the direction of an arrow B along the clutch shaft 50.

Additionally, an outer clutch gear 64 is rotatably mounted on the clutch shaft 50.

In operation, the outer clutch gear 64 of the clutch unit is brought in meshing engagement with the transmission gear 32 via a clutch transmission pinion 66 and the a clutch transmission gear 86 both pivoted on the motor base 22. Thus the outer clutch gear 64 is normally rotated by the paper feed motor 24.

As shown in FIG. 1, in general, since the inner clutch plate 60 is removed from the outer clutch gear 64 by the clutch return spring 54, only the outer clutch gear 64 rotates even during the paper feeding by the paper feed motor 24, while the inner clutch plate 60 and the bail lever gear **44*a* meshing therewith does not rotate. During normal paper feeding, the bail roller 40** will never receive any influence of the paper feed driving force.

But when the clutch unit is switched over to the connecting position, the drive force of the paper feed motor 24 directly acts on the bail roller 40 for pivotal movement.

FIG. 3 shows one example of a carriage 70 which serves to assist in connecting and disconnecting the clutch unit. Although there is no detail illustration in the drawings, the carriage 70 carries a printing head for desired printing on a paper wound on the platen 12.

In FIG. 3, when the carriage 70 is moved from an ordinary printing area indicated by C to an outer area D outside the printing area C, the clutch shaft 50 of the clutch unit is pushed in the direction of an arrow B by the end surface **70*a* of the carriage 70**.

At that time, the inner clutch plate 60 is brought into frictional engagement with the outer clutch gear 64 so that the rotation of the outer clutch gear 64 is transmitted to the clutch shaft 50 via the inner clutch plate 60. And then the rotation of the clutch shaft 50 is transmitted to the bail lever gear **44*a* of the bail lever 44 via the pivoting gear 48. Thus the connecting of the clutch unit is accomplished as the carriage 70 is moved to the outer area D outside the printing area C. In this position, as the paper feed motor 24 is started to rotate, the bail lever 44** is pivotally moved.

As discussed above, in this invention, when the clutch unit is rendered connected as the carriage is moved out of the printing area, the bail roller is pivotally moved selectively to the loading position and the release position under the control of the paper feed driving force. Further the bail roller can be retained in such a selected position. The pivotal movement of this bail roller is controlled by various sensors.

These sensors include a carriage sensor for detecting the home position of the carriage 70, a bail roller sensor for detecting whether the bail roller 40 is in the loading position or the release position, and a paper sensor for detecting whether the paper is in a position ready to be supplied to the platen.

Specifically, a carriage sensor 80 for detecting the home position of the carriage 70 is shown in FIG. 3; this carriage sensor 80 is a non-contact photoelectric sensor disposed near the traveling path of the carriage 70 for optically detecting the home position of the carriage 70 for printing. Alternatively, the carriage sensor 80 may be a light transmission or shielding type or a contact type.

Accordingly, the carriage sensor 80 can detect whether the carriage 70 is moved to the left end so that in the general printing, the leftward shift position of the carriage 70 is determined by the carriage sensor 80. During the pivotal movement of the bail roller 40, the connecting and disconnecting of the clutch can be controlled by shifting the carriage 70 leftwardly further from the home position detected by the carriage sensor 80.

Figure 5:
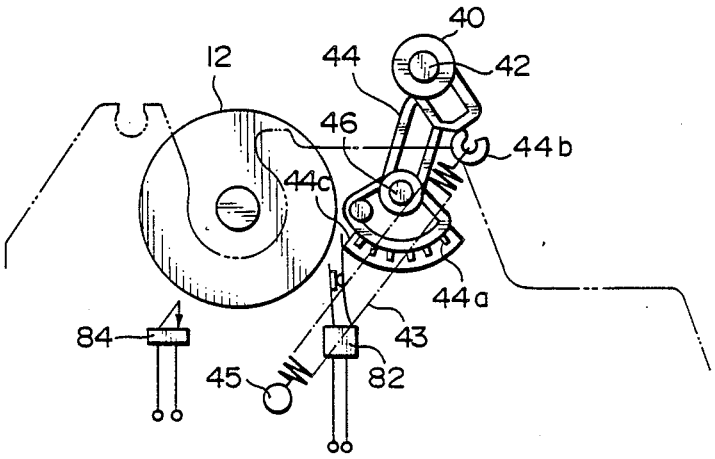
FIG. 5 is a view similar to FIG. 4, showing a bail roller having been pivotally moved from the loading position to a release position and retained in the latter position by the toggle unit.

FIGS. 4 and 5 show a bail roller sensor 82 and a paper sensor 84.

The bail roller sensor 82 is a contact type; it detects the gear end 44c of the bail lever 44. When the bail roller 40 is in the loading position as shown in FIG. 4, the bail roller sensor 82 is inoperative. When the bail roller 40 is in the release position as shown in FIG. 5, the contact of the bail roller sensor 82 is urged to the operative position of the bail roller sensor 82 so that the release position or the bail roller 40 can be detected by the bail roller sensor 82.

Meanwhile, the paper sensor 84 is disposed under the platen 12 for detecting whether the paper has been fed until it is held between the platen 12 and a non-illustrated pinch roller, and outputting a signal. For this purpose, the paper sensor 84 is in the form of a reflection-type photointerrupter.

The operation of the automatic paper loading mechanism of this invention will now be described.

When feeding a sheet paper, the pinch roller is pressed against the platen to advance the paper. When feeding a tractor paper, the pinch roller is released from the platen, and then the tractor paper is set on a non-illustrated tractor unit. The tractor paper is advanced in response to rotation of the tractor gear 18. For full-automatic paper loading, a paper feed switch on an operation panel is switched on after completion of paper setting.

Firstly, a carriage drive such as a pulse motor drives the carriage 70 to move out of the outer area D of FIG. 3, thus causing the clutch unit to assume the connecting position. In practice, the amount of contact force between the clutch plate 60 and the outer clutch gear 64, with the clutch unit in connecting position, is determined by the amount of compression force of the clutch spring 62, thus normally obtaining a virtually stable connecting action.

Since the clutch unit has a play between the stop ring 58 and the outer clutch gear 64, it is unnecessary that the movement of the carriage 70 out of the printing area to pivotally move the bail roller 40 should be controlled with high precision.

When after completion of connecting of the clutch unit, the paper feed motor 24 rotates reversely, the paper feed driving force is transmitted to the bail roller 40 for pivotal movement. Thus the bail roller 44 is pivotally moved clockwise from the loading position 100 to the release position 200 in FIG. 2. Therefore, by controlling the drive of the paper feed motor 24, it is possible to release the bail roller 40 from the platen 12 reliably and then to move the bail roller 40 to the release position 200 reliably.

When the bail roller 40 is thus spaced from the platen 12 reliably to the release position 200, the carriage 70 is moved rightwardly in FIG. 3 into the printing area C, thus causing the clutch unit to assume the disconnecting position. However, in this position, the resilient force of the toggle spring 43 is acting on the bail lever 44, as shown in FIG. 5, so that the bail roller 40 can be retained in the release position 200 also as the clutch unit assumes the disconnecting position.

Then, in the release position of the bail roller 40, the paper is fed to a predetermined position as the paper feed motor 24 rotates forwardly, during which time the paper feeding can be completed without being interfered by the bail roller 40. During this paper feeding, the leading end position of the paper is detected and recorded by the paper sensor 84 so that a controller of the printer grasps the leading end position of the paper exactly.

At that time, the amount of feed of the paper may be such that the leading end position will be a predetermined printing start position. Or the amount of feed of the paper may be set to be short of the predetermined printing start position by a certain amount of forward feeding for the bail roller 40 to return to the loading position 100.

After the paper has thus been fed to a desired position, the bail roller 40 is pivotally moved to the loading position for loading action.

Like the release action, the loading action of the bail roller 40 is to move the carriage 70 to the outer area D outside the printing area so that the clutch unit assumes the connecting position.

In this position, as the paper feed motor 24 rotates forwardly, the bail roller 40 is thereby moved to the loading position 100 of FIG. 2 to complete a desired loading action. As a result, as shown in FIG. 4, the bail roller 40 is pressed against the platen 12 by the resilience of the toggle spring 43.

With the bail roller 40 pressed against the platen 12, the carriage 70 is moved again rightwardly in FIG. 3 toward the printing area C. As a result, the clutch unit has been rendered disconnected.

As mentioned above, a single cycle of automatic paper loading has been completed without any operation by the operator. Further, the bail roller 40 has automatically been moved without any exclusive drive.

When a paper is to be printed to the very limit to the upper margin, it is possible to start printing while the bail roller 40 is released from the platen 12 to the release position 200.

At that time, since the leading end of the paper does not yet reach the bail roller 40, the loading action of the bail roller 40 is conducted with the leading end of the paper projecting a predetermined amount from the bail roller 40 as printing is conducted several times or as unloaded feeding is conducted.

This loading action is performed by the connecting of the clutch unit due to the carriage 70 and subsequently by the forward feeding of the paper due to the paper feed motor 24. As a result, the loading of the bail roller 40 creates a certain amount of deviation of the paper in the direction of forward paper feeding with respect to the printing position during the printing. Finally, this deviation is corrected by backwardly feeding the paper by the paper feed motor 24 for the above-mentioned amount of forward feeding.

In either case, the paper feeding and the pivotal movement of the bail roller can be controlled in full-automatic fashion.

Figures 6, 6A:
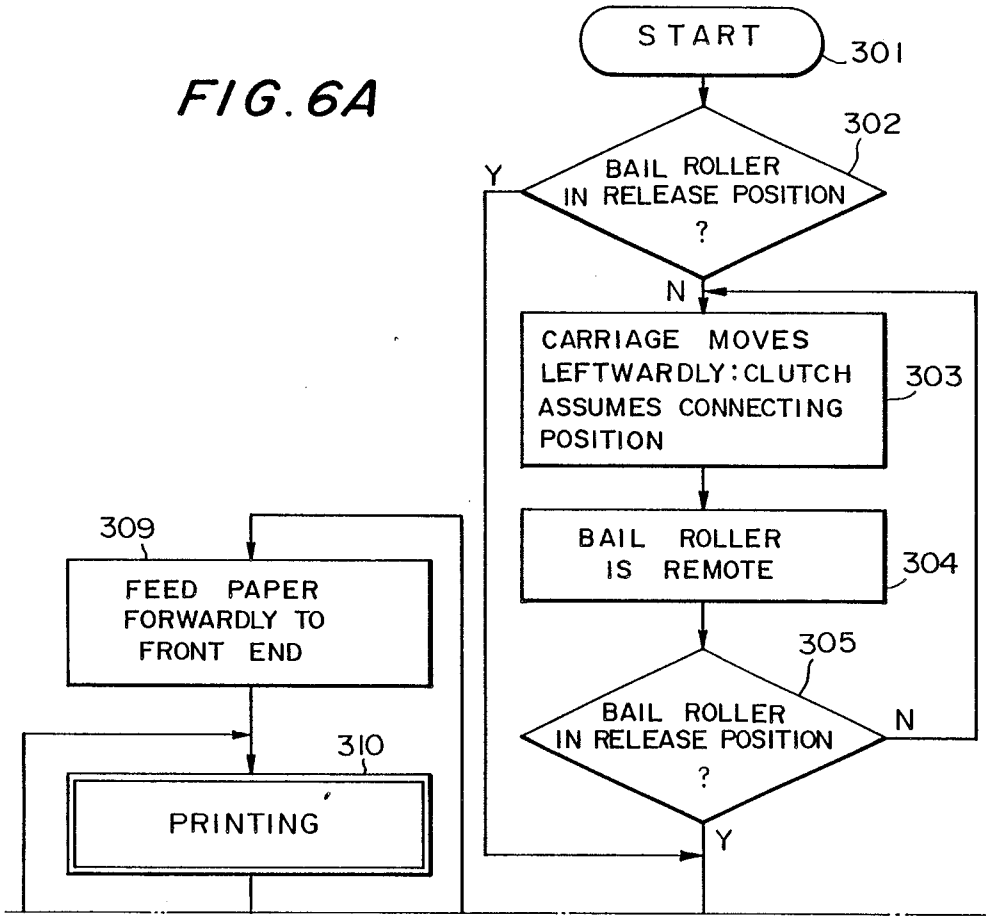
FIG. 6 is a flowchart showing one example of automatic paper loading according to this invention.
Figure 6B:
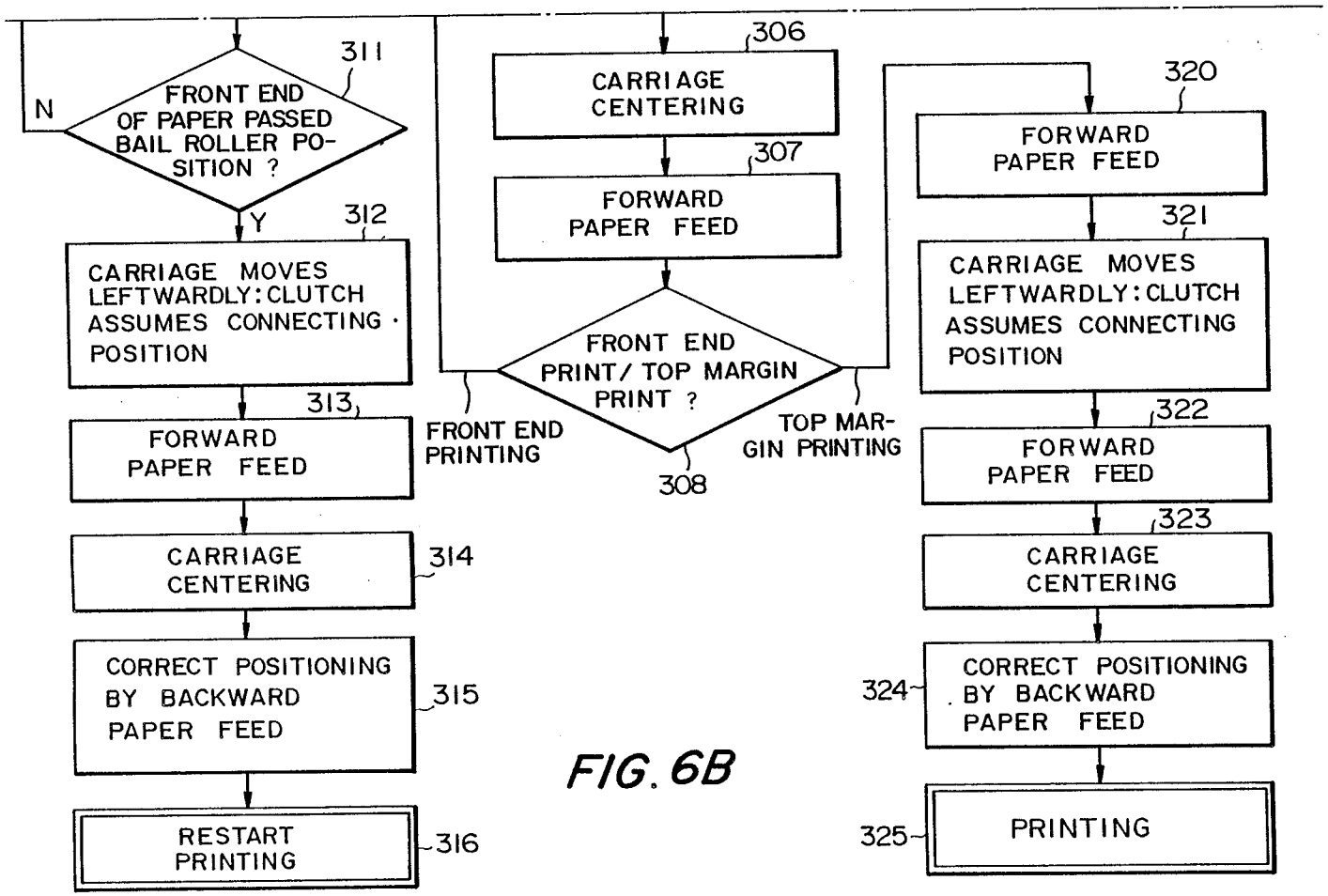

FIG. 6 is a flowchart showing the manner in which printing is made on a sheet paper at its leading end or its top margin as the sheet paper is automatically loaded on the platen.

In the leading end printing, printing is started from the topmost end with almost no margin at the top end. In this case, with the bail roller retained in the release position, desired printing is performed. Especially according to this invention, since the release position is retained by the toggle means, the paper can be fed forwardly or backwardly at option even in the case of leading end printing, thus enabling high-concentration printing and double-strike printing, for example.

The top margin printing is an ordinary printing in which an optional margin is left at the leading end of the paper for printing. In this top margin printing, the bail roller must be returned to the loading position by the printing start time.

When the paper supply switch on the operation panel is switched on (step 301), it is discriminated by the bail roller switch 82 whether the bail roller 40 is in the release position or not (step 302).

In the ordinary case, the bail roller 40 is disposed in the loading position, the carriage 70 is driven to make a leftward shift (step 303), thereby causing the clutch unit to assume the connecting position.

Then at step 304, backward paper feeding is conducted, and the bail roller 40 is released from the loading position of FIG. 4 toward the release position of FIG. 5 via the clutch unit.

At step 305 it is discriminated by the bail roller switch 82 whether the bail roller 40 is again moved to the release position, and the above steps 303, 304 are repeated until the bail roller 40 is moved exactly to the position of FIG. 5.

As the bail roller switch 82 is switched on at step 305, namely, the bail roller 40 reaches the released position, the carriage 70 is centered at step 306 for ready to perform a correct printing action on a paper being supplied, or for retaining the paper at the centered position.

In this invention, the bail roller 40 is reliably retained in the release position by the toggle unit. Since the bail roller 40 is retained even if the carriage is centered and also even if the clutch unit assumes the disconnecting position, the bail roller 40 is prevented from returning to the loading position.

At the above step 302, if the bail roller 40 is already disposed in the release position, the routine procedure proceeds from step 302 directly to step 306, as a matter of fact.

Upon completion of reliable release of the bail roller 40, the forward paper feeding is conducted at step 307, and selection between the leading end printing and the top margin printing is made at step 308.

This change-over between the leading end printing and the top margin printing is discriminated according to the user's instruction from the operation panel. When the leading end printing is selected, the forward paper feeding is conducted to the leading end of the paper at step 309. This paper feeding is performed by feeding the paper by a predetermined number of steps after the leading end of the paper has been supplied to the pinch roller.

For the leading end printing, with the bail roller 40 in the release position, the leading end of the paper advances to the printing position to start the ordinary printing at step 310.

Thus the printing, with the bail roller 40 in the release position, is continued until the leading end of the paper passes the bail roller 40. At step 311, the loading action of the bail roller 40 is started when the number of steps of paper feeding reaches a value such that the leading end of the paper passes the bail roller position.

The carriage 70 is shifted leftwardly at step 312 so that the clutch unit assumes the connecting position to start the loading action, whereupon the forward paper feed is conducted at step 313 so that the bail roller 40 is moved from the release position of FIG. 5 to the loading position of FIG. 4. And this loading position is retain again by the toggle unit. Then the carriage 70 is centered at step 314, after which the above-mentioned amount of unnecessary forward feeding during the bail roller loading at the above step 313 is corrected by backward paper feeding.

As discussed above, since the bail roller 40 is retained reliably in the loading position by the toggle means to cause the paper to return the correct printing position, printing is restart at step 316.

If the top margin printing is selected at the above step 308, the forward paper feeding is conducted at step 320 to feed the paper to the position in which the leading end of the paper passes the bail roller 40 to take a desired top margin. Further, like steps 312 through 315, the loading action of the bail roller 40 is conducted throughout steps 321 to 324 to start a printing action at step 325.

In the foregoing method of FIG. 6, partly because the movement of the bail roller 40 is controlled according to the connecting and disconnecting of the clutch unit by the carriage 70, and partly because the loading position and the release position respectively are retained by the toggle unit, it is possible to control the carriage 70, the paper feeding and the bail roller 40 individually independently so that a variety of complex and high-quality printing actions can be achieved.

According to this invention, it is possible to perform the pivotal movement of the bail roller in a full-automatic fashion without an exclusive drive source for the bail roller. Namely, a cycle of printing operation is completed only by switching on the paper supply switch on the operation panel, thereby realizing a printer that is excellent in operativity.

Further, since the bail roller is driven by the paper feed motor, it is possible to reduce the entire printer to a compact size. Since unlike the conventional manual drive means for the bail roller, there is not any projection such as a bail lever extending outside, it is possible to eliminate any leakage of printing noise from the opening for the bail lever, thus realizing a low-noise printer.

What is claimed is:

1. An automatic paper loading mechanism for a printer, comprising:

(a) a platen for supporting therearound a paper at a predetermined printing area;

(b) a bail roller for pressing the paper against said platen;

(c) a paper feed unit having a paper feed motor for rotating said platen to feed the paper by a predetermined amount;

(d) a printing head disposed in confronting relation to said platen for performing a predetermined printing action on the paper;

(e) a carriage for moving said printing head in a direction parallel to the axis of said platen;

(f) a pivoting unit pivotally movable between a paper loading position in which said pivoting unit brings said bail roller against said platen and a paper release position in which said pivoting unit brings said bail roller away from said platen;

(g) a clutch unit disposed between said pivoting unit and said paper feed unit for operatively connecting said paper feed unit to said pivoting unit to transmit a driving force of said paper feed unit to said pivoting unit and for disconnecting said paper feed unit from said pivoting unit, said clutch unit being adapted to be switched over to its connecting position when said carriage is moved to an outer area outside said printing area; and (h) a toggle unit for resiliently retaining said bail roller at said loading position and said release position individually, said carriage being freely movable along said platen while said bail roller is being retained in said release position.

2. An automatic paper loading mechanism according to claim 1, wherein said clutch unit has a clutch shaft slidable in the direction of movement of said carriage, the connecting and disconnecting operations of said clutch unit being controlled by axial movement of said clutch shaft, and wherein said carriage has an end surface engageable with said clutch shaft to move said clutch shaft in the connecting direction when said carriage is moved to said outer area outside said printing area.

3. An automatic paper loading mechanism according to claim 2, wherein said clutch unit includes:

a clutch return spring normally urging said clutch shaft toward said carriage;

an outer clutch gear rotatably pivoted on said clutch shaft for being driven by said paper feed motor of said paper feed unit; and an inner clutch plate axially movably mounted on said clutch shaft and rotatable as a unit with said clutch shaft, said inner clutch plate being couplable as a unit with said outer clutch gear when said clutch shaft is moved by said carriage against the bias of said clutch return spring.

4. An automatic paper loading mechanism according to claim 3, wherein said pivoting unit includes a pivoting gear axially slidably mounted on said clutch shaft and rotatable as a unit with said clutch shaft.

5. An automatic paper loading mechanism according to claim 4, wherein said bail roller is rotatably mounted on a bail roller shaft fixed to one end of a bail lever fixed at the other end to a pivot bail gear meshing with said pivoting gear, wherein said bail roller is pivotally moved about said pivot bail gear between said loading position and said release position in response to the turning movement of said pivoting gear.

6. An automatic paper loading mechanism according to claim 5, wherein said bail lever has a hook, said toggle unit including a toggle spring connected at one end to said hook of said bail lever, said bail lever being retained selectively in said loading position or said release position by said toggle unit as the center line of said toggle spring is shifted between the loading-position side and the release-position side with respect to said pivot bail gear.

7. An automatic paper loading mechanism according to claim I, further including a carriage sensor for detecting a home position of said carriage, whereby said clutch unit assumes the connecting position as said carriage is moved beyond said home position and outside said printing area of said platen.

8. An automatic paper loading mechanism according to claim 1, further including a bail roller sensor for detecting said loading position and said release position of said bail roller, whereby the timing of connecting and disconnecting of said clutch unit by said carried is determined based on the output of said bail roller sensor.

9. An automatic paper loading mechanism according to claim 1, further including a paper sensor for detecting whether the paper is fed to said predetermined printing area of said platen.

10. In a printer in which printing is to be made on a desired printing area of a paper wound on a platen as the paper is retained by a bail roller and as a printing head carried by a carriage is moved forwardly and backwardly and in which a drive force to feed the paper can be utilized to cause the bail roller to pivotally move between a paper loading position and a paper release position as the printing head or the carriage is moved to an outer area outside the printing area to cause a clutch to assume its connecting position and in which the bail roller is retained in the loading position and the release position individually by a toggle unit, an automatic paper loading method comprising the steps of:

(a) moving the carriage to a clutch connecting position in which the bail roller is pivotally movable to a paper release position in which the bail roller is spaced from the platen;

(b) feeding the paper backwardly and, at the same time, pivotally moving the bail roller to the release position by the paper feed drive force and retaining the bail roller in the release position by the toggle unit;

(c) removing the carriage from the clutch connecting position to release the pivotal movement of the bail roller which movement is caused by the paper feed drive force;

(d) feeding the paper forwardly to a predetermined position;

(e) moving the carriage to the clutch connecting position; and (f) further feeding the paper forwardly and, at the same time, moving the bail roller to the loading position and retaining the bail roller in the loading position by the toggle unit.

11. An automatic paper loading method according to claim 10, wherein printing is started as a top margin printing upon completion of pressing the paper against the platen by the bail roller according to the step (f).

12. An automatic paper loading method according to claim 10, wherein printing is started as a leading printing as the bail roller is in the release position according to the step (b).

13. An automatic paper loading method according to claim 10, wherein said predetermined position of the step (d) is set at a printing start line.

14. An automatic paper loading method according to claim 10, wherein said predetermined position of the step (d) is determined in anticipation of amount of possible paper returning during the paper loading.

15. An automatic paper loading method according to claim 10, wherein the carriage is centered during said forward paper feeding of the step (d).

* * * * *